US005718064A

United States Patent [19]

Pyle

[11] Patent Number: 5,718,064

[45] Date of Patent: Feb. 17, 1998

[54] MULTI-LAYER SOLE CONSTRUCTION FOR WALKING SHOES

[75] Inventor: Clifford L. Pyle, Cincinnati, Ohio

[73] Assignee: Nine West Group Inc., Stamford, Conn.

[21] Appl. No.: 523,948

[22] Filed: Sep. 6, 1995

Related U.S. Application Data

[63] Continuation of Ser. No. 222,013, Apr. 4, 1994, abandoned.

[51] Int. Cl.[6] ..... A43B 13/18; A43B 7/06; A43B 13/38

[52] U.S. Cl. ..... 36/28; 36/3 B; 36/44

[58] Field of Search ..... 36/25 R, 2 B, 36/3 B, 3 R, 43, 44, 30 R

[56] References Cited

U.S. PATENT DOCUMENTS

| | | | |
|---|---|---|---|
| 2,348,336 | 5/1944 | Everston . | |
| 3,766,669 | 10/1973 | Pearsall | 36/43 |
| 3,824,716 | 7/1974 | DiPaolo | 36/32 R |
| 3,971,145 | 7/1976 | Stegerwald | 36/32 R |
| 4,016,661 | 4/1977 | Tibbitts | 36/4 |
| 4,128,950 | 12/1978 | Bowerman et al. | 36/30 R |
| 4,185,402 | 1/1980 | Digate | 36/44 |
| 4,316,332 | 2/1982 | Giese et al. | 36/28 |
| 4,316,335 | 2/1982 | Giese et al. | 36/129 |
| 4,319,412 | 3/1982 | Muller et al. | 36/59 C |
| 4,361,912 | 12/1982 | Arthur | 36/114 |
| 4,398,357 | 8/1983 | Batra | 36/30 A |
| 4,399,620 | 8/1983 | Funck | 36/30 R |
| 4,461,099 | 7/1984 | Bailly | 36/44 |
| 4,463,505 | 8/1984 | Duclos | 36/30 R |
| 4,481,726 | 11/1984 | Phillips | 36/30 A |
| 4,513,518 | 4/1985 | Jalbert et al. | 36/44 |
| 4,551,930 | 11/1985 | Graham et al. | 36/30 R |
| 4,564,966 | 1/1986 | Chen | 12/146 B |
| 4,641,438 | 2/1987 | Laird et al. | 36/59 C |
| 4,654,983 | 4/1987 | Graham et al. | 36/30 R |
| 4,667,423 | 5/1987 | Autry et al. | 36/102 |
| 4,676,010 | 6/1987 | Cheskin | 36/32 R |
| 4,709,490 | 12/1987 | Fottingor et al. | 36/44 |
| 4,757,620 | 7/1988 | Tiitola | 36/28 |
| 4,760,652 | 8/1988 | Austin | 36/30 R |
| 4,897,936 | 2/1990 | Fuerst | 36/31 |
| 4,999,237 | 3/1991 | Mellors et al. | 36/43 |
| 5,025,573 | 6/1991 | Giese et al. | 36/30 R |
| 5,068,983 | 12/1991 | Marc | 36/44 |
| 5,146,698 | 9/1992 | Tilles et al. | 36/44 |
| 5,147,589 | 9/1992 | Chang et al. | 264/45.1 |
| 5,163,237 | 11/1992 | Rosen | 36/97 |
| 5,174,049 | 12/1992 | Flemming | 36/28 |
| 5,216,825 | 6/1993 | Brum | 36/44 |
| 5,384,974 | 1/1995 | Massimo | 36/28 |

*Primary Examiner*—B. Dayoan

*Attorney, Agent, or Firm*—Senniger, Powers, Leavitt & Roedel

[57] ABSTRACT

A conforming sole construction for a walking shoe is characterized by a flexible PVC outsole containing in its upper surface a low density polyurethane insert for shock absorption. Mounted on the upper surface of the outsole and insert is a combined footbed and multilayered socklining. The footbed is formed of EVA and includes integral heel and arch support portions. The socklining has a lower layer of shock absorbing closed cell foam material, a layer of latex material containing humidity and odor absorbing carbon particles, an upper layer of open cell ergonomic foam material, and a cover layer of woven water absorbing and polyester fiber materials for wicking moisture from the foot of the wearer. The sole construction provides increased support for the heel and arch of the wearer's foot and improved cushioning over the length of the foot.

13 Claims, 3 Drawing Sheets

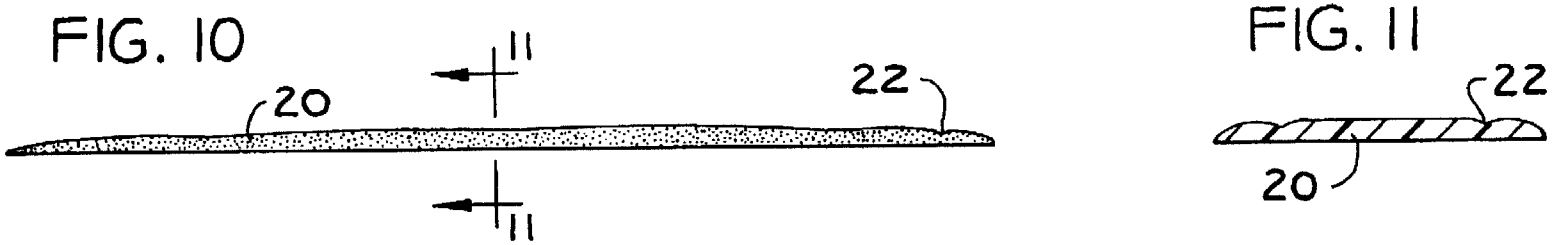
FIG. 10
FIG. 11
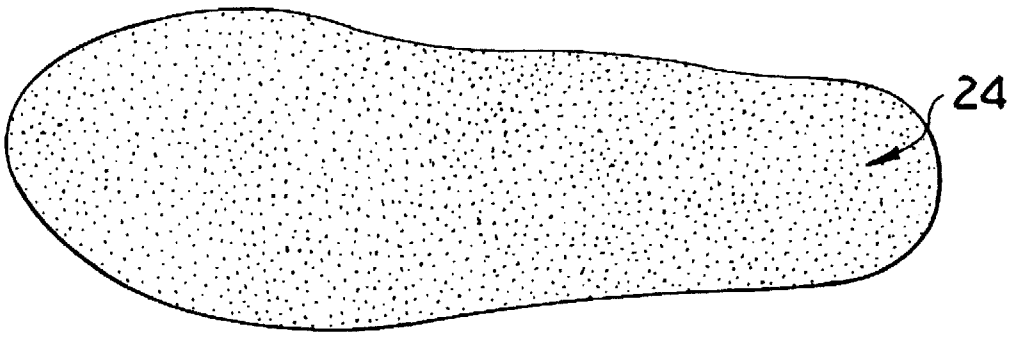
FIG. 12
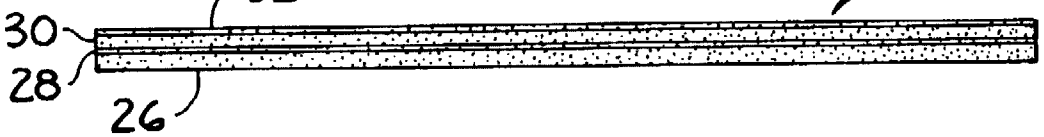
FIG. 13
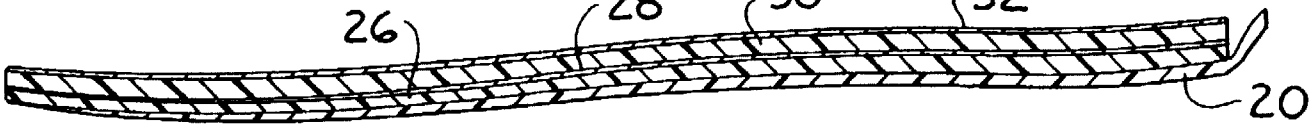
FIG. 14

MULTI-LAYER SOLE CONSTRUCTION FOR WALKING SHOES

This is a continuation of application Ser. No. 08/222,013, filed Apr. 4, 1994 now abandoned.

BACKGROUND OF THE INVENTION

A walking shoe as its name implies is a shoe specifically designed for walking. Such shoes are characterized by a shoe sole and upper construction which increases the support for the wearer's foot and which provides a high degree of comfort. As distinguished from running shoes, a walking shoe is typically of sturdier construction, with far more rigid support for proper pronation to prevent damage to the wearer's foot and joints. It is also important that a walking shoe be lightweight while absorbing shocks resulting from walking or other forms of exercise.

The present invention relates to a walking shoe having a sole and footbed which conforms to the foot of the wearer while providing cushioning and support thereto.

BRIEF DESCRIPTION OF THE PRIOR ART

Prior art walking shoes include shoe sole constructions for athletic footwear comprising an outsole including an outer border portion and an inner foam core which extends longitudinally beneath the heel for cushioning as shown in the U.S. patent to Bowerman et al U.S. Pat. No. 4,128,950.

The present invention was developed in order to provide a cushioning and support system for a walking shoe which does not require a midsole. Rather, the shoe sole of the invention includes a contoured footpad and multi-layered socklining.

SUMMARY OF THE INVENTION

Accordingly, it is a primary object of the invention to provide a conforming sole construction for a walking shoe including a flexible polyvinyl chloride outsole containing a longitudinal recess in the upper surface thereof within which is molded an insert formed of shock-absorbing low density polyurethane material. A contoured footbed formed of ethylene vinyl acetate (EVA) material is mounted on the upper surface of the outsole and insert. Connected with the footbed is a multi-layered socklining. The lower layer of the socklining is a shock-absorbing foam material above which is provided a layer of latex containing carbon particles for absorbing moisture and odor. Above the latex layer is a layer of open cell, medium density ergonomic foam material which provides high energy absorption and which softens as the temperature rises. The socklining is covered with a layer of woven hydrofill and polyester fiber materials for wicking moisture from the foot of the wearer.

According to a more specific object of the invention, the outsole includes a plurality of polyvinyl chloride traction inserts molded into cavities in the bottom surface thereof to define a dual density outsole.

It is another object of the invention to use a vinyl nitrile closed cell foam material for the shock-absorbing foam of the socklining.

According to yet another object of the invention, the footpad includes integral arch and heel support portions which extend beyond the peripheral edge of the socklining.

BRIEF DESCRIPTION OF THE FIGURES

Other objects and advantages of the invention will become apparent from a study of the following specification when viewed in the light of the accompanying drawing in which:

FIGS. 9 and 10 are top and side plan views, respectively, of the footpad according to the invention;

FIG. 11 is a sectional view of the footpad taken along line 11—11 of FIG. 10;

FIGS. 12 and 13 are top and side plan views, respectively, of the socklining according to the invention; and FIG. 14 is a side sectional view of the footpad with the socklining connected therewith.

DETAILED DESCRIPTION

Figure 1:
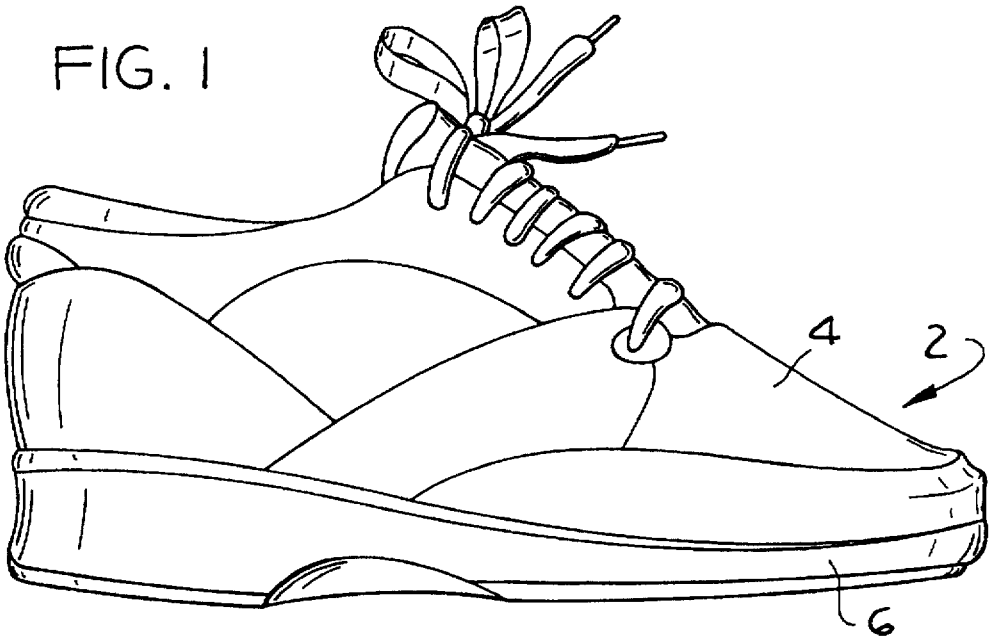
FIG. 1 is a side plan view of a walking shoe incorporating the conforming sole construction according to the invention.

There is shown in FIG. 1 a walking shoe 2 including an upper 4 and the conforming sole 6 of the invention. The upper is a special last designed specifically for walking. It is formed of water resistant leather and includes an upper strapping system which provides lateral and medial forefoot support. The upper includes padded tongue and collar portions for comfort and protection against rubbing.

Figure 2:
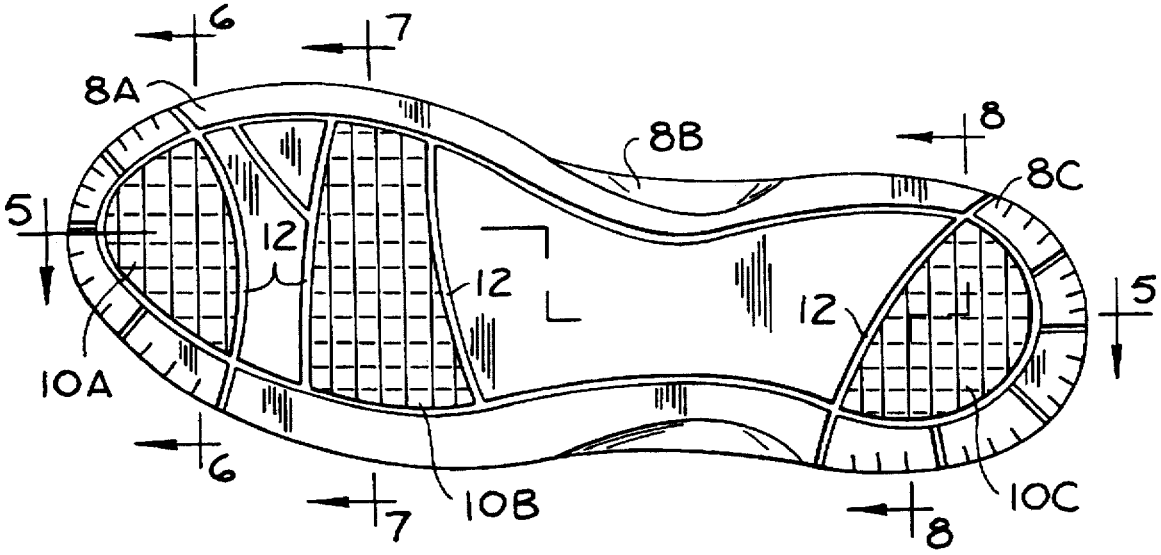
FIG. 2 is a bottom plan view of the shoe sole according to the invention.
Figure 3:
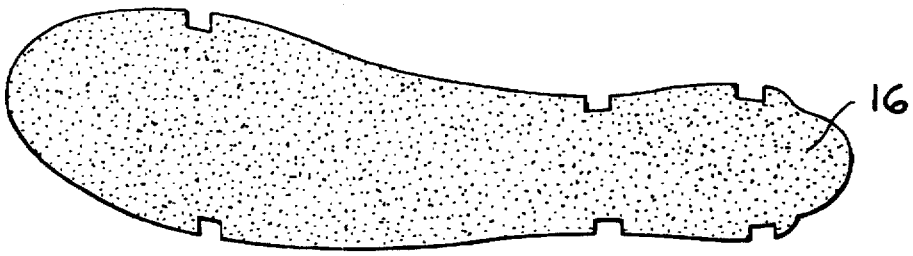
FIGS. 3 and 4 are top and side plan views, respectively, of the insert for the shoe sole.
Figure 4:
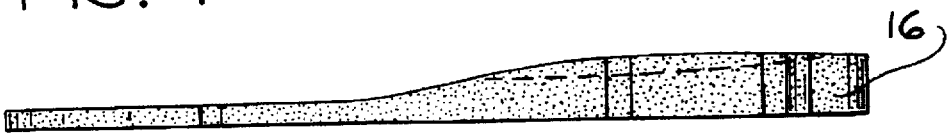
Figure 5:
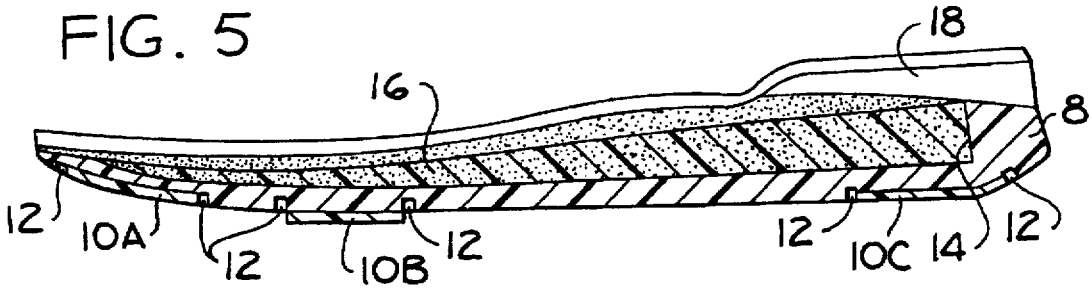
FIG. 5 is a side sectional view of the outsole and insert.
Figure 6:
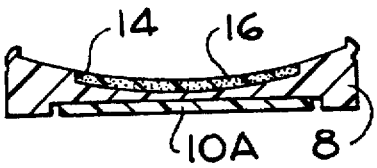
FIGS. 6, 7, and 8 are sectional views taken along line 6—6, 7—7, and 8—8, respectively, of FIG. 2.
Figure 7:
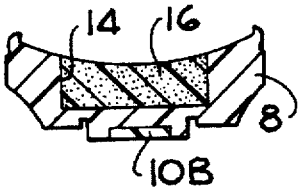
Figure 8:
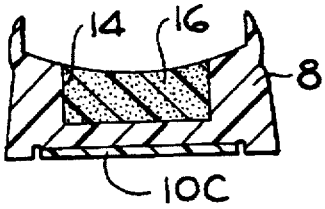
Figure 9:
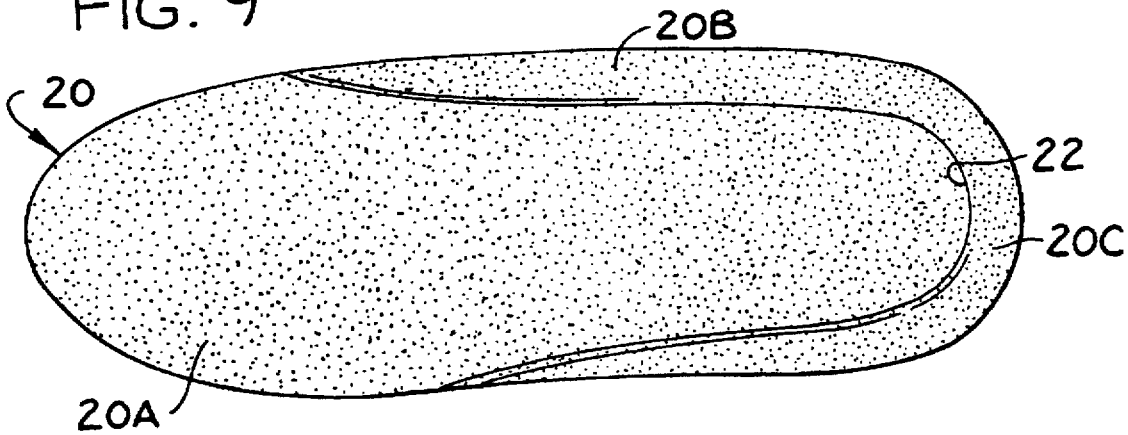

The conforming sole of the invention will be described with reference to FIGS. 2–14. In FIG. 2, the outsole 8 is shown. It is a lightweight, flexible injection molded unit formed of polyvinyl chloride material. The outsole includes forepart **8*a*, arch 8*b*, and heel 8*c* portions and in the bottom surface of the outsole are recesses in the toe, ball, and heel areas within which traction inserts 10*a–c* are molded. The inserts are also formed of polyvinyl chloride material, but have a higher density than the outsole. The outsole also contains a plurality of grooves 12** which define a rolled grid design which facilitates easy walking.

The upper surface of the outsole 8 contains a longitudinal recess 14 as shown in FIGS. 5–8 within which is molded an insert 16 formed of shock-absorbing material, preferably low density polyurethane, which increases the cushioning provided to the foot of the wearer of the walking shoe 2. The upper surface of the insert is generally flush with the upper surface of the outsole. At the rear of the outsole is an integral vertically extending lip 18 which is arranged at the peripheral edge of the heel portion **8*c*** of the outsole. The lip defines a stabilizer for the heel of the wearer's foot.

Mounted on the upper surfaces of the outsole 8 and insert 14 is a contoured footbed 20 (FIGS. 9–11) formed of a microcellular mixture of synthetic plastic and elastic materials. A preferred composition of the footbed is 9 pound ethylene vinyl acetate (EVA) having a specific gravity in the range of 0.15 to 0.40 and a shore C diameter range of 25 to 45. The footbed extends continuously over the upper surfaces of the outsole and insert to completely cover the same. It includes integral central **20*a*, arch 20*b* and heel portions 20*c* which are defined by a shire or scoreline 22**. The arch and heel portions of the footbed provide increased support to the arch and heel of the wearer's foot.

A multilayered socklining 24 is shown in FIGS. 12 and 13. It is fastened to the upper surface of the central portion **20*a* of the footbed as shown in FIG. 14**. Any suitable adhesive can be used to fasten the socklining to the footbed. Moreover, conventional adhesives are used to interconnect the layers of the socklining.

Referring to FIG. 13, the lower layer 26 of the socklining comprises a shock-absorbing foam material. Preferably, the shock absorbing foam material comprises a vinyl nitrile closed cell foam material which resists permanent compression. Such a material is compressible but returns to its natural configuration when pressure, such as from the weight of the wearer, is removed. Thus, the foam conforms somewhat to the wearer's foot during use but resumes its regular state when not in use.

Above the shock-foam layer 26 is a layer of latex material 28 which contains a plurality of carbon particles for absorbing odor. The carbon particles comprise active carbon in the form of small globules embedded in an open cellular latex foam material. The globules, which have a diameter of between 0.1 and 0.8 mm, can withstand high loads and thus do not burst or separate from the latex material. Moreover, no carbon dust is created which preserves the cleanliness of the shoe. The carbon particles also absorb humidity to help keep the socklining dry.

Above the latex layer 28 is a layer 30 of open cell medium density ergonomic foam material which provides high energy absorption. It is a urethane product and softens as the temperature increases, such as a result of contact with the wearer's foot, particularly during exercise. As the material softens, it provides uniform pressure distribution and firm support. Because the foam is an open cell material, air and moisture readily pass through the layer 30 to the latex/carbon particle layer 28.

The top layer 32 of the socklining serves as a cover and comprises a layer of woven water absorbing and polyester fiber materials which wick moisture from the wearer's foot.

As set forth above and as shown in FIG. 14, the socklining 24 and footbed 20 are connected together and profile molded to conform to the character of the last bottom, thereby providing the wearer with ultimate comfort of the contoured last bottom. The outsole unit provides superior cushioning and shock absorption and has on its bottom surface a special tread design which maximizes forepart flexibility and traction. It also has a rolled grid design for easy walking and a heel cup stabilizer which holds the wearer's heel in proper position for safer more efficient walking. Finally, the insert maintains cushioning for the life of the shoe.

While in accordance with the provisions of the patent statute the preferred forms and embodiments of the invention have been illustrated and described, it will be apparent to those of ordinary skill in the art that various changes may be made without deviating from the inventive concepts set forth above.

What is claimed is:

1. A conforming sole construction for a walking shoe, comprising (a) a flexible outsole containing a longitudinal recess in an upper surface and extending continuously between forepart and heel portions thereof, said outsole being made of a wear resistant material;

(b) an insert formed of shock-absorbing material and arranged in said outsole recess;

(c) a contoured footbed mounted on and completely covering the upper surface of said outsole and insert; and (d) a multi-layered socklining lying on and connected with an upper surface of said footbed, said socklining including the following layers, in order, from top to bottom: (1) a layer of water absorbing material, (2) a foam layer having high energy absorption and temperature softening behavior, (3) a layer of odor absorbing material, and (4) a shock absorbing foam layer which resists permanent compression.

2. A conforming sole construction as defined in claim 1, wherein said outsole includes a lip extending vertically from a peripheral edge of said heel portion defining a stabilizer for the heel of the foot of the wearer.

3. A conforming sole construction as defined in claim 2, wherein said outsole is formed of polyvinyl chloride material.

4. A conforming sole construction as defined in claim 3, wherein a lower surface of said outsole contains a plurality of recesses within which traction inserts are molded, said traction inserts being formed of a polyvinyl chloride material having a higher density than said outsole.

5. A conforming sole construction as defined in claim 2, wherein said insert is formed of a low density polyurethane material which increases the cushioning provided to the foot of the wearer.

6. A conforming sole construction as defined in claim 5, wherein said footbed includes a central portion and integral arch and heel support positions.

7. A conforming sole construction as defined in claim 6, wherein said footbed contains a scoreline between said main portion and said arch and heel support portions, said socklining being connected with said central portion and having a peripheral edge colinear with said scoreline.

8. A conforming sole construction as defined in claim 7, wherein said footbed is formed of ethylene vinyl acetate.

9. A conforming sole construction as defined in claim 1, wherein said temperature softening foam layer is made from an open cell medium density material.

10. A conforming sole construction as defined in claim 1, wherein said odor absorbing layer is made from a laytex material containing carbon particles.

11. A conforming sole construction as defined in claim 1, wherein said water absorbing layer is made from polyester fiber material for wicking moisture from the foot of the wearer.

12. A conforming sole construction as defined in claim 1, wherein said socklining shock-absorbing foam material comprises a vinyl nitrile closed cell foam material which resists permanent compression.

13. A conforming sole construction for a walking shoe, comprising an outsole made from a polyvinyl chloride material; the outsole having an elongate recess in an upper surface;

a shock-absorbing insert made of polyurethane material arranged in said outsole recess, said insert substantially filling the recess and extending continuously between the forepart and heel portions of the outsole;

a contoured footbed mounted on and completely covering the upper surface of said outsole and insert; and a multi-layered socklining lying on and connected with an upper surface of said footbed, said socklining including the following layers, in order, from top to bottom: (1) a water absorbing layer made from polyester material for wicking moisture from the foot of the wearer, (2) a temperature softening foam layer made from an open cell medium density material, (3) an odor absorbing layer made from a laytex material containing carbon particles, and (4) a shock-absorbing foam layer made from a vinyl nitrile closed cell material which resists permanent compression.

* * * * *